US010161633B2

(12) United States Patent
Chew et al.

(10) Patent No.: US 10,161,633 B2
(45) Date of Patent: Dec. 25, 2018

(54) AIR SWIRLERS

(71) Applicants: Delavan Inc, West Des Moines, IA (US); Phyllis Hetheriton, West Des Moines, IA (US)

(72) Inventors: Gary Chew, West Des Moines, IA (US); Viraphand Cholvibul, Urbandale, IA (US); Philip E. O. Buelow, West Des Moines, IA (US); Jason Allen Ryon, Carlisle, IA (US)

(73) Assignee: Delavan Inc., Des Moines, IA (US)

( * ) Notice: Subject to any disclaimer, the term of this patent is extended or adjusted under 35 U.S.C. 154(b) by 490 days.

(21) Appl. No.: 13/783,832

(22) Filed: Mar. 4, 2013

(65) Prior Publication Data

US 2014/0245742 A1 Sep. 4, 2014

(51) Int. Cl.
*F23R 3/14* (2006.01)
*F23D 14/24* (2006.01)
(Continued)

(52) U.S. Cl.
CPC ..... *F23R 3/14* (2013.01); *F23C 7/002* (2013.01); *F23D 11/103* (2013.01); *F23D 11/105* (2013.01); *F23D 11/107* (2013.01); *F23D 11/383* (2013.01); *F23D 14/24* (2013.01); *F23R 3/12* (2013.01); *F23R 3/28* (2013.01); *F23R 3/286* (2013.01); *F23R 3/343* (2013.01);
(Continued)

(58) Field of Classification Search
CPC ..... F05D 2240/127; F23C 7/002; F23R 3/12; F23R 3/14; F23R 3/286; F23D 11/103; F23D 11/105; F23D 11/107; F23D 11/383; F23D 14/24; F23D 2900/14021; F23D 2900/14701
See application file for complete search history.

(56) References Cited

U.S. PATENT DOCUMENTS 1,462,395 A * 7/1923 Thompson ..... F23D 11/103 239/404
4,407,128 A * 10/1983 Kwan ..... F23D 11/107 239/402
(Continued)

FOREIGN PATENT DOCUMENTS

EP 1 605 204 A2 12/2005
EP 2 500 641 A1 9/2012
EP 2 589 867 A2 5/2013

OTHER PUBLICATIONS

Extended European Search Report and Opinion dated Dec. 4, 2014 for Application No. 14157662.9.

*Primary Examiner* — Scott Walthour
(74) *Attorney, Agent, or Firm* — Locke Lord LLP; Scott D. Wofsy; Joshua L. Jones

(57) ABSTRACT

A swirler, such as for swirling air in a fuel injector of a gas turbine engine, includes a swirler body with opposed inlet and outlet ends with a swirler wall extending therebetween along a longitudinal axis. The inlet end of the swirler body defines an inlet opening. A plurality of swirl slots is defined through a portion of the swirler wall that converges toward the longitudinal axis in a direction from the inlet opening toward the outlet end of the swirler body. The swirl slots are radially off-set with respect to the longitudinal axis for imparting swirl on a flow passing from the inlet opening, through the swirl slots, and past the outlet end of the swirler body.

9 Claims, 4 Drawing Sheets

(51) Int. Cl.

| | |
|---|---|
| ***F23D 11/10*** | (2006.01) |
| ***F23R 3/34*** | (2006.01) |
| ***F23R 3/28*** | (2006.01) |
| ***F23R 3/12*** | (2006.01) |
| ***F23C 7/00*** | (2006.01) |
| ***F23D 11/38*** | (2006.01) |

(52) U.S. Cl.
CPC ..... *F05D 2240/127* (2013.01); *F23D 2900/11101* (2013.01); *F23D 2900/14021* (2013.01); *F23D 2900/14701* (2013.01)

(56) References Cited

U.S. PATENT DOCUMENTS

| | | | | |
|---|---|---|---|---|
| 4,941,617 | A * | 7/1990 | Russell | F23D 11/107 239/400 |
| 5,579,645 | A | 12/1996 | Prociw et al. | |
| 6,016,658 | A * | 1/2000 | Willis | F23R 3/02 239/405 |
| 6,360,776 | B1 * | 3/2002 | McCormick et al. | 137/896 |
| 7,926,282 | B2 | 4/2011 | Chew et al. | |
| 8,925,325 | B2 * | 1/2015 | Overman | F23C 9/006 60/737 |
| 9,188,063 | B2 * | 11/2015 | Prociw | F23R 3/28 |
| 9,644,844 | B2 * | 5/2017 | Prociw | F23R 3/346 |
| 2003/0110776 | A1 | 6/2003 | Teets | |
| 2005/0279862 | A1 * | 12/2005 | Mao | F23D 11/107 239/403 |
| 2010/0287939 | A1 | 11/2010 | Cornwell et al. | |
| 2011/0031333 | A1 * | 2/2011 | Short | F23D 11/383 239/548 |
| 2012/0234013 | A1 * | 9/2012 | Overman | F23C 9/006 60/772 |

* cited by examiner

AIR SWIRLERS

BACKGROUND OF THE INVENTION

1. Field of the Invention

The present invention relates to nozzles and injectors, and more particularly to swirlers for nozzles and injectors in gas turbine engines.

2. Description of Related Art

In a fuel nozzle for a gas turbine engine, compressor discharge air is used to atomize liquid fuel. More particularly, the air provides a mechanism to break up a fuel sheet into a finely dispersed spray that is introduced into the combustion chamber of an engine. Quite often the air is directed through a duct that serves to turn or impart swirl to the air. This swirling air flow acts to stabilize the combustion reaction.

There are many ways to develop swirl in a fuel nozzle. Historically, helically vaned swirlers were used because of their ability to effectively turn the air flow. These helical vanes generated acceptable air flow characteristics for many engine applications. Helically vaned air swirlers are traditionally placed upstream in the internal air path of a nozzle. Fuel injected into the swirling flow is mixed with air for combustion downstream.

Such conventional methods and systems have generally been considered satisfactory for their intended purpose. However, there is still a need in the art for swirlers that allow for improved flow characteristics, thermal performance, and adaptability to specific applications. There also remains a need in the art for such swirlers that are easy to make and use. The present invention provides a solution for these problems.

SUMMARY OF THE INVENTION

The subject invention is directed to a new and useful swirler, such as for swirling air in a fuel injector of a gas turbine engine. The swirler includes a swirler body with opposed inlet and outlet ends with a swirler wall extending therebetween along a longitudinal axis. The inlet end of the swirler body defines an inlet opening. A plurality of swirl slots is defined through a portion of the swirler wall that converges toward the longitudinal axis in a direction from the inlet opening toward the outlet end of the swirler body. The swirl slots are radially off-set with respect to the longitudinal axis for imparting swirl on a flow passing from the inlet opening, through the swirl slots, and past the outlet end of the swirler body.

In accordance with certain embodiments, the swirl slots are elongated in a direction along the swirler wall. Each swirl slot can extend along the swirler wall in a direction oblique axially and circumferentially relative to the longitudinal axis. The swirler wall can define an axial cross-sectional profile that is bullet-shaped.

In certain embodiments, the swirler wall defines an axial cross-sectional profile that is trapezoidal. The outlet end of the swirler body can include a planar portion of the swirler wall that is substantially perpendicular to the longitudinal axis. The swirl slots can be cylindrical bores through the swirler wall.

In another aspect, it is contemplated that in certain embodiments the only flow path through the swirler wall is through the swirl slots. It is also contemplated that the outlet end of the swirler body can include at least one bore passing through the swirler wall in an axial direction relative to the longitudinal axis.

The invention also provides an injector having an injector body with opposed inlet and outlet ends. A liquid flow circuit passes through the injector body from the inlet end to the outlet end. An inner air circuit is defined through the injector body along a longitudinal axis. A swirler is mounted to the injector body. The swirler includes a swirler wall extending within the inner air circuit from an inlet opening of the swirler to a downstream end of the swirler along the longitudinal axis. A plurality of swirl slots is defined through the swirler wall. The swirl slots are radially off-set with respect to the longitudinal axis for imparting swirl as described above.

In certain embodiments, a flow passage is defined between the swirler wall and a wall of the inner air circuit of the injector body. The flow passage can have a cross-sectional area that increases in a direction along the longitudinal axis towards the downstream end of the swirler. The swirl slots can feed into the flow passage.

In another aspect, a swirler as described above can be mounted to an injector body, such as the injector body described above, upstream of the inner air circuit, e.g., with the swirler flipped axially relative to the orientation described above so the swirl slots are defined through a portion of the swirler wall that diverges relative to the longitudinal axis in a direction from the upstream end of the swirler to the downstream opening of the swirler.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 1:
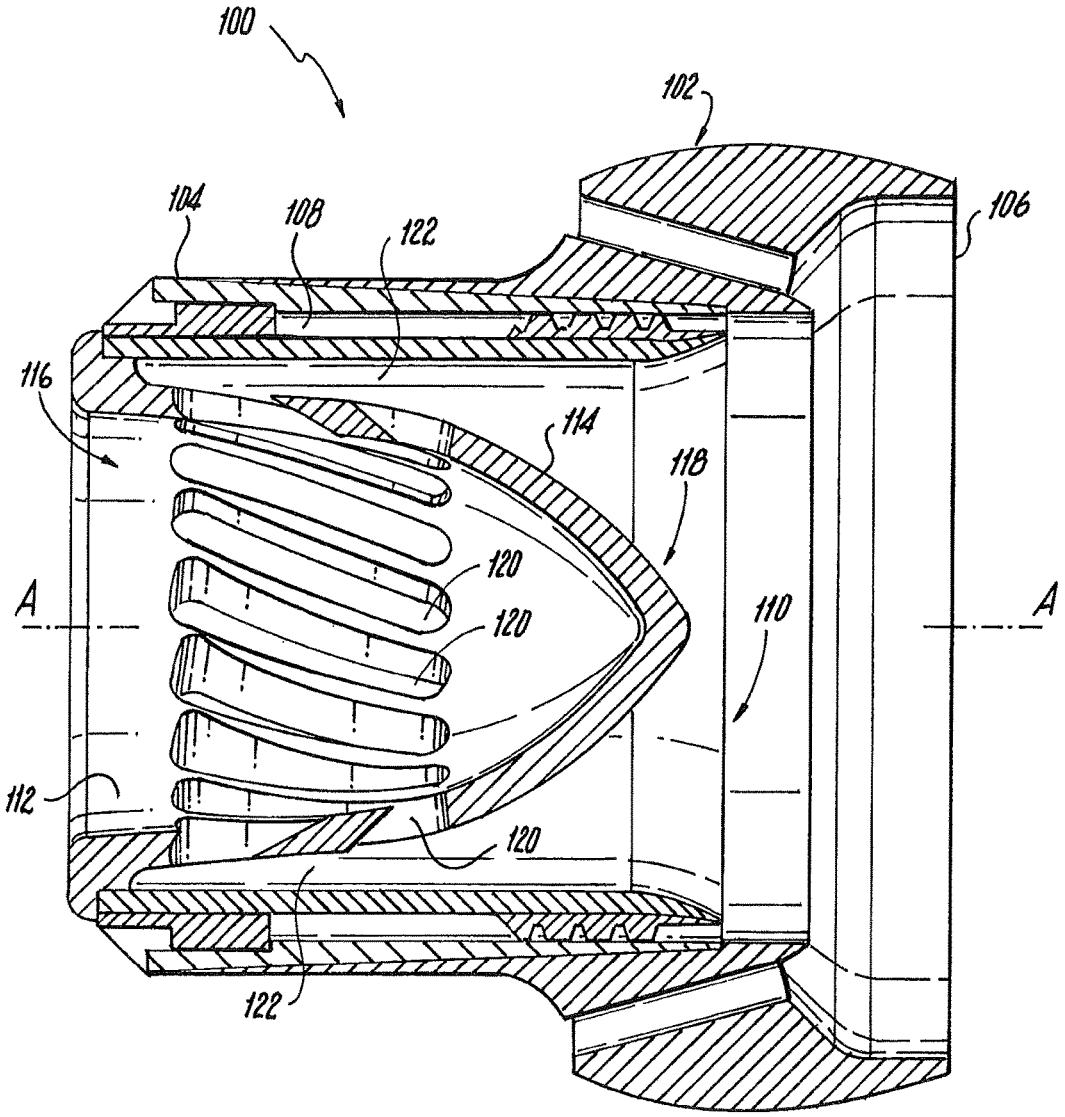
FIG. 1 is a cross-sectional side elevation view of an exemplary embodiment of an injector constructed in accordance with the present invention, showing the swirler mounted in the inner air circuit.

Reference will now be made to the drawings wherein like reference numerals identify similar structural features or aspects of the subject invention. For purposes of explanation and illustration, and not limitation, a partial view of an exemplary embodiment of an injector in accordance with the invention is shown in FIG. 1 and is designated generally by reference character 100. Other embodiments of injectors in accordance with the invention, or aspects thereof, are provided in FIGS. 2-7, as will be described. The systems and methods of the invention can be used to provide a swirling flow, for example in inner air circuits of fuel injectors.

Referring now to FIG. 1 injector 100 includes an injector body 102 with opposed inlet and outlet ends 104 and 106, respectively. A liquid flow circuit 108 passes through injector body 102 from inlet end 104 to outlet end 106. An inner air circuit 110 is defined through injector body 102 along longitudinal axis A. A swirler 112 is mounted to injector body 102.

Figure 2:
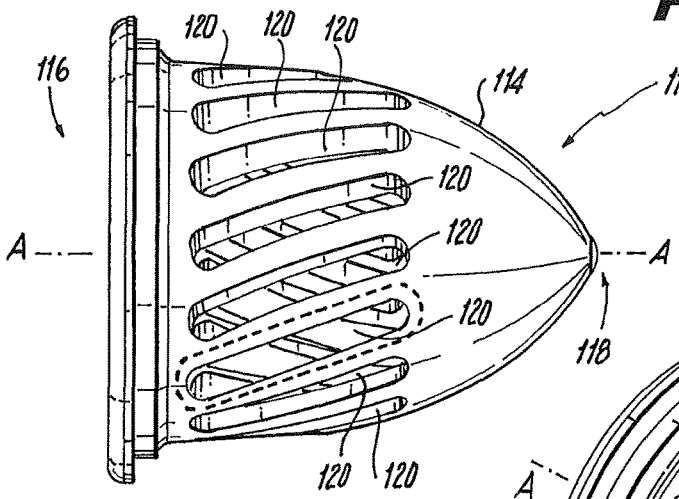
FIG. 2 is a side elevation view of the swirler of FIG. 1, showing the slot milling plane.

Referring now to FIG. 2, swirler 112 includes a swirler wall 114 extending within inner air circuit 110, as shown in FIG. 1, from an upstream inlet end of swirler 112 to an opposed downstream outlet end 118 of swirler 112 along longitudinal axis A. The inlet end of swirler 112 defines an inlet opening 116 where air can be introduced to the interior space within swirler wall 114. A plurality of swirl slots 120 is defined through swirler wall 114. Swirl slots 120 are radially off-set with respect to longitudinal axis A. One of the swirl slots 120 is circled to indicate the swirl slot defined directly into and out of the viewing plane as viewed in FIG. 2, which is below longitudinal Axis A. Since all of the swirl slots 120 are radially off-set in this manner, they impart swirl on a flow passing from the inlet opening 116, through swirl slots 120, and past downstream end 118 of the swirler body.

Figure 3:
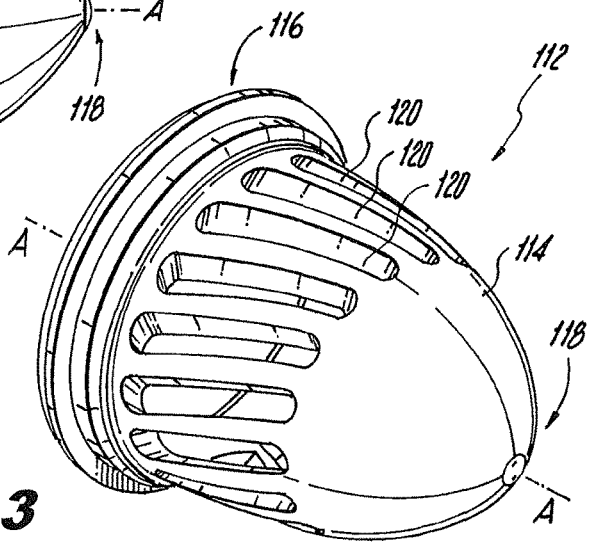
FIG. 3 is a perspective view of the swirler of FIG. 2, showing the downstream end of the swirler.

With reference now to FIGS. 2 and 3, swirl slots 120 are defined through a portion of the swirler wall 114 that converges toward longitudinal axis A in a direction from the inlet opening 116 toward outlet end 118 of the swirler body. Swirl slots 120 are elongated in a direction along swirler wall 114. Each swirl slot 120 extends along swirler wall 114 in a direction oblique axially and circumferentially relative to longitudinal axis A. In other words, each slot 120 extends partly circumferentially around swirler wall 114 it extends along swirler wall 114 in the axial direction.

Referring again to FIG. 1, swirler wall 114 defines an axial cross-sectional profile that is bullet-shaped. As also shown in FIG. 3, the downstream outlet end 118 of swirler wall 114 is closed off so the only flow path through swirler wall 114 is through swirl slots 120. A flow passage 122 is defined between swirler wall 114 and the wall of inner air circuit 110 of injector body 102. Flow passage 122 has a cross-sectional area that increases in the direction along longitudinal axis A towards the downstream outlet end 118 of swirler 112. Swirl slots 120 feed into flow passage 122. This arrangement of swirl slots 120 and flow passage 122 causes high velocity air flow to be closer to the fuel injection point of liquid flow circuit 108 than would be the case for traditional swirlers. This can enhance atomization of the liquid issued from circuit 108, for example enhancing fuel atomization in fuel injection applications.

Figure 4:
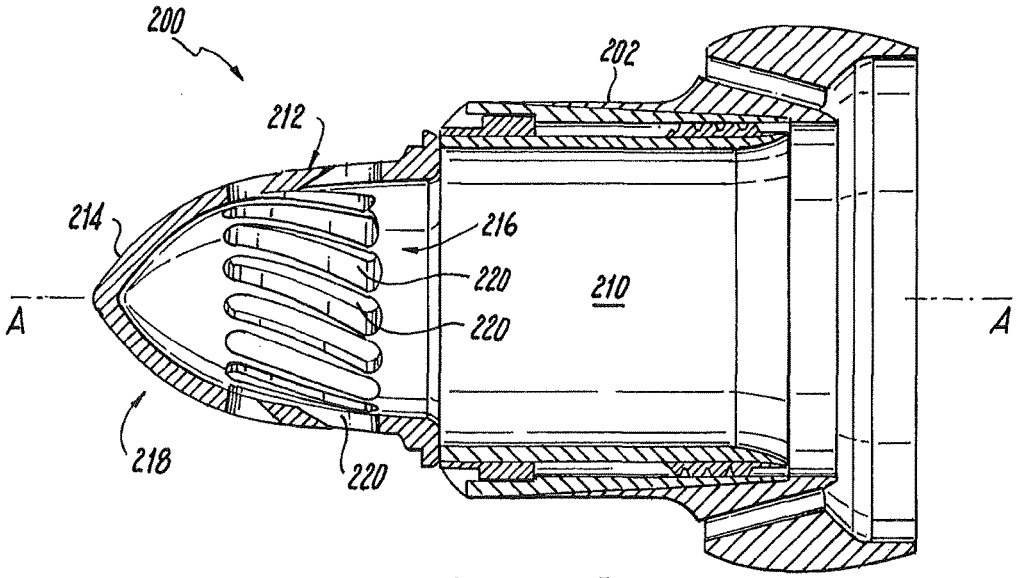
FIG. 4 is a cross-sectional side elevation view of another exemplary embodiment of an injector constructed in accordance with the present invention, showing the swirler mounted in an axially inverted position relative to that shown in FIG. 1.

With reference now to FIG. 4, another exemplary embodiment of an injector 200 with a swirler 212 much as described above is shown, in which swirler 212 is mounted to an injector body 202 and is positioned upstream of inner air circuit 210. In other words, compared to injector 100 described above, injector 200 has the swirler 212 flipped axially relative to the orientation described above, so swirl slots 220 are defined through a portion of swirler wall 214 that diverges relative to the longitudinal axis A in a direction from the upstream end 218 of swirler 212 to downstream opening 216 of swirler 212. Whereas in injector 100 described above, the air flow direction is radially outward through swirl slots 120, in injector 200 the flow direction is radially inward through swirl slots 220. This reversal of the direction of swirl slots 220 changes the flow characteristics of the swirling flow through air circuit 210, which can be suitable for certain applications.

Figure 5:
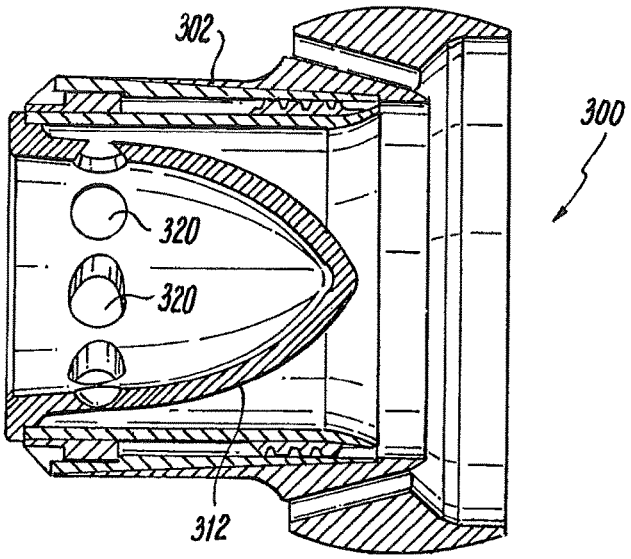
FIG. 5 is a cross-sectional side elevation view of another exemplary embodiment of an injector constructed in accordance with the present invention, showing swirl slots in the swirler that are cylindrical.
Figure 6:
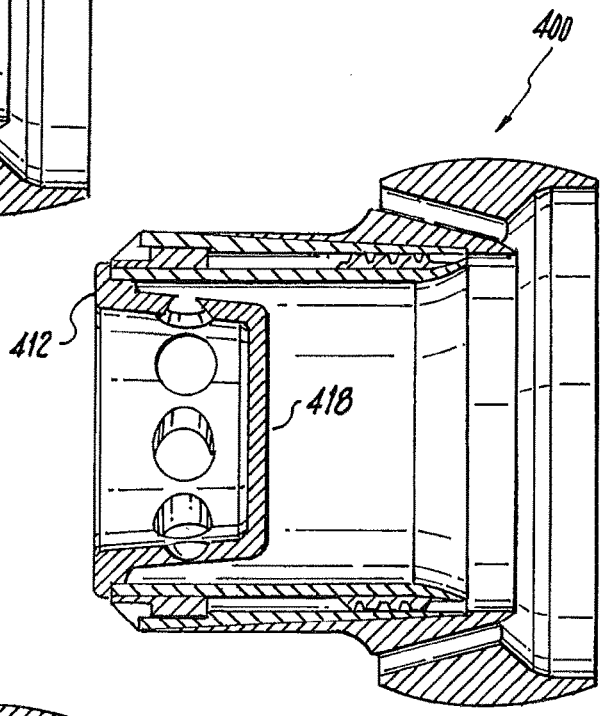
FIG. 6 is a cross-sectional side elevation view of another exemplary embodiment of an injector constructed in accordance with the present invention, showing a swirler wall with a trapezoidal cross-sectional profile.
Figure 7:
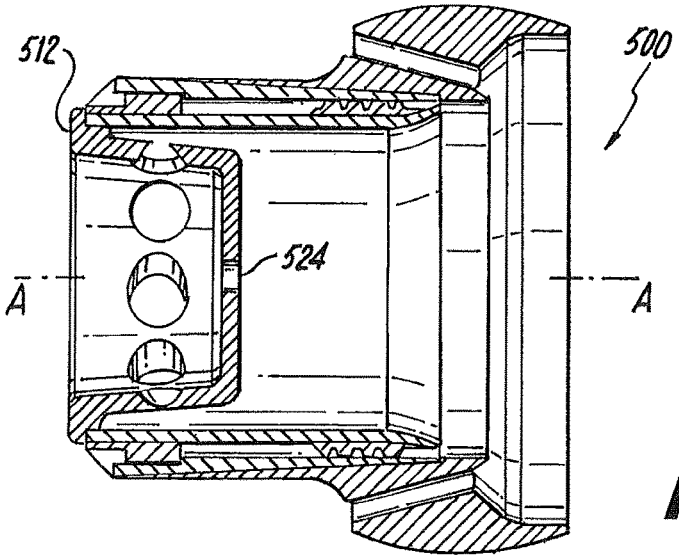
FIG. 7 is a cross-sectional side elevation view of another exemplary embodiment of an injector constructed in accordance with the present invention, showing a similar swirler to that shown in FIG. 6, but with a through bore along the axis.

Referring now to FIGS. 5-7, it is contemplated that while swirl slots 120 and 220 described above are elongated slots, cylindrical slots can also be used. For example, in FIG. 5 injector 300 includes an injector body 302 and swirler 312 much as those described above except that swirl slots 320 are radially off-set cylindrical bores through the swirler wall. This discrete jet type configuration creates a swirling flow pattern that is suitable for certain applications. The swirl slots described herein can all be formed by any suitable process, such as milling or any other suitable process. The milling plane for one swirl slot 120 indicated with the dashed line around the swirl slot 120 in FIG. 1, is parallel with the viewing plane. Each of the swirlers described herein can be formed as a single piece mounted to the respective injector body by brazing or any other suitable process.

While injectors 100, 200, and 300 described above include swirlers having bullet-shaped cross-sectional profiles, any other suitable cross-sectional profile can be used as well. For example, injector 400 in FIG. 6 includes a swirler 412 having a swirler wall with a trapezoidal cross-sectional profile. The outlet end 418 of this swirler body includes a planar portion of the swirler wall that is substantially perpendicular to longitudinal axis A.

Referring now to FIG. 7, injector 500 includes a swirler 512 similar to that described above with reference to FIG. 6 except that the outlet end of the swirler body includes a bore 524 passing through the swirler wall in an axial direction relative to longitudinal axis A. Injectors 100, 300, and 400 described above all have swirler walls with closed downstream ends so that the only path through the respective swirlers is through the swirl slots. There is flow separation downstream of the swirler walls with a recirculation zone formed in flow through the inner air circuit in these embodiments that has beneficial flame holding characteristics. Bore 524 in injector 500 does not eliminate the flame holding characteristics described above, however it does allow for the flame holding region of the flow to be pushed downstream to allow increased space between the swirler wall and the flame. This can be beneficial in applications where it is desired to have some flame holding characteristics, but where it is also desired to reduce the temperature of the swirler wall for thermal management, for example. Those skilled in the art will readily appreciate that while described as having a single bore 524 defined in the axial direction, any other suitable number of bores can be used, and in any suitable orientation for a given application. For example, the downstream portion of the swirler wall, e.g., swirler wall 418, could include multiple bores aligned tangentially to impart swirl on flow passing therethrough.

While described above in the exemplary context of having a single set of swirl slots in each swirler, those skilled in the art will readily appreciate that multiple sets of swirl slots can be used in a swirler. For example, in injectors 300, 400, and 500 a single set of radially off-set cylindrical swirl slots is provided around the circumference of each swirler. However, additional sets of co- or counter-rotating swirl slots could be added in these swirlers to provide suitable flow characteristics for given applications.

Figure 8:
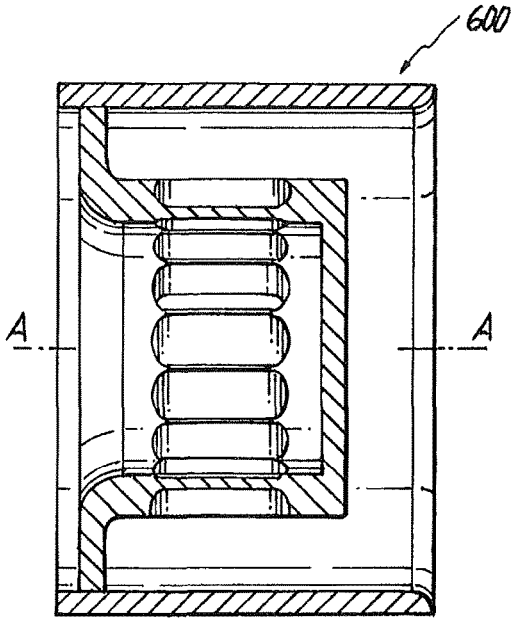
FIG. 8 is a cross-sectional side elevation view of another exemplary embodiment of an injector constructed in accordance with the present invention, showing a swirler having a swirler wall with a constant diameter.
Figure 9:
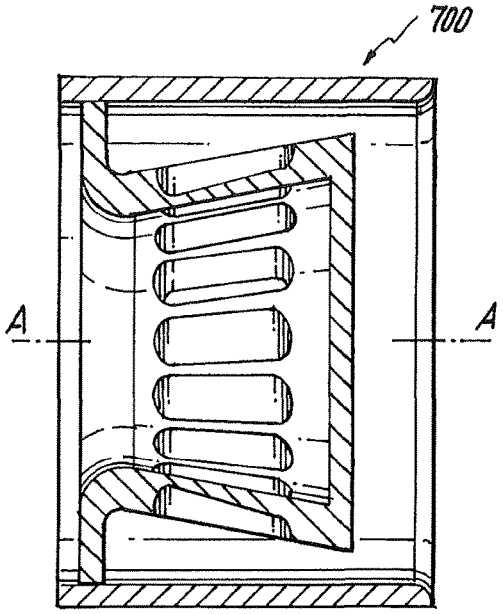
FIG. 9 is a cross-sectional side elevation view of another exemplary embodiment of an injector constructed in accordance with the present invention, showing a swirler having a swirler wall that diverges towards the outlet.
Figure 10:
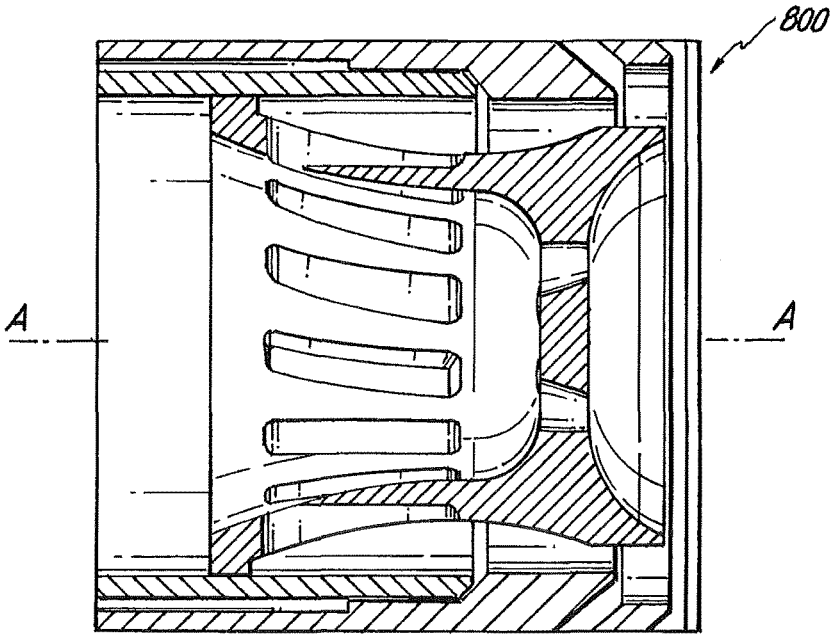
FIG. 10 is a cross-sectional side elevation view of another exemplary embodiment of an injector constructed in accordance with the present invention, showing a swirler having a converging-diverging swirler wall.

While described above in the exemplary context of injectors with swirlers therein having swirler walls that converge, those skilled in the art will readily appreciate that any other suitable swirler wall profile can be used for a given application. For example, FIGS. 8, 9, and 10 show injectors with swirlers 600, 700, and 800 with swirler walls having a constant diameter, diverging diameter, and converging-diverging diameter, respectively. In FIG. 10, for example, the converging-diverging swirler wall is positioned such that the downstream diverging portion of the swirler wall is located at the exit of the liquid spin-chamber. This positioning permits the highest velocity air to be directed across the liquid sheet, providing effective atomization.

One potential benefit of swirlers as described herein over traditional axial type swirlers, which typically include a centerline bluff body, is related to thermally induced stresses. Swirlers as described herein can tend to undergo relatively uniform temperature changes compared to traditional swirlers with bluff bodies. The bluff bodies tend to have large thermal masses, resulting in considerable thermal gradients across the swirl vanes, which is not necessarily the case with swirlers as described herein.

While shown and described in the exemplary context of air flow through inner air circuits for fuel injectors in gas turbine engines, those skilled in the art will readily appreciate that injectors and swirlers as described herein can be used in any other suitable application. Moreover, injectors and swirlers as described herein can be used to swirl any suitable fluid, including liquids, as needed for specific applications. Various embodiments are described herein with features that vary from embodiment to embodiment to provide different flow characteristics. Those skilled in the art will readily appreciate that any of these features can be adapted and/or used in combination to suit specific applications. Additionally, while the swirlers described herein are shown mounted in exemplary injector bodies, those skilled in the art will readily appreciate that swirlers as described herein can be used in any other suitable type of injector, nozzle, or other envelope without departing from the scope of the invention. In short, the swirlers described herein provide considerable design flexibility so that the flow characteristics can be tailored for specific applications.

The methods and systems of the present invention, as described above and shown in the drawings, provide for swirlers with superior properties including flow characteristics, thermal management, and adaptability for specific applications. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A fuel injector comprising:

an injector body with opposed inlet and outlet ends with a liquid flow circuit passing through the injector body in a direction parallel to a longitudinal axis of the injector body, the liquid flow circuit extending from the inlet end of the injector body to the outlet end of the injector body, wherein an inner air circuit is defined through the injector body along the longitudinal axis of the injector body; and a swirler mounted to the injector body having a swirler body with opposed inlet and outlet ends with a swirler wall extending within the inner air circuit and between the opposed inlet and outlet ends of the swirler body along the longitudinal axis, the inlet end of the swirler body defining an inlet opening, wherein a plurality of swirl slots are defined through a portion of the swirler wall that converges toward the longitudinal axis in a direction from the inlet opening toward the outlet end of the swirler body, wherein the plurality of swirl slots are each radially off-set with respect to the longitudinal axis for imparting swirl on a flow passing from the inlet opening, through the plurality of swirl slots, and past the outlet end of the swirler body, wherein the only flow path though the swirler wall is through the plurality of swirl slots.

2. The fuel injector as recited in claim 1, wherein a portion of the inner air circuit defined between the swirler wall and a wall of the inner air circuit of the injector body has a cross-sectional area that increases in a direction along the longitudinal axis towards the outlet end of the swirler body.

3. The fuel injector as recited in claim 2, wherein the plurality of swirl slots feed into the portion of the inner air circuit defined between the swirler wall and the wall of the inner air circuit.

4. The fuel injector as recited in claim 1, wherein each of the swirl slots are elongated in a respective direction along the swirler wall.

5. The fuel injector as recited in claim 4, wherein each respective direction is oblique axially and circumferentially relative to the longitudinal axis.

6. The fuel injector as recited in claim 1, wherein the swirler wall defines an axial cross-sectional profile that is bullet-shaped.

7. The fuel injector as recited in claim 1, wherein the swirler wall defines an axial cross-sectional profile that is trapezoidal and wherein the outlet end of the swirler body includes a planar portion of the swirler wall that is substantially perpendicular to the longitudinal axis.

8. The fuel injector as recited in claim 1, wherein each swirl slot is a cylindrical bore through the swirler wall.

9. The fuel injector as recited in claim 1, wherein the swirler wall is a converging-diverging swirler wall.

* * * * *